United States Patent [19]

Buck

[11] 3,977,686

[45] Aug. 31, 1976

[54] SELF-EJECTING CHUCK KEY FOR GEAR CHUCK

[75] Inventor: James R. Buck, Ross Township, Kalamazoo County, Mich.

[73] Assignee: Buck Tool Company, Kalamazoo, Mich.

[22] Filed: Oct. 24, 1974

[21] Appl. No.: 517,738

[52] U.S. Cl. ..... 279/1 K; 81/90 R

[51] Int. Cl.[2] ..... B25B 13/44

[58] Field of Search ..... 279/1 K; 81/90 R, 90 A; 70/414

[56] References Cited

UNITED STATES PATENTS

| | | | |
|---|---|---|---|
| 2,488,240 | 11/1949 | Rumsey | 70/414 |
| 2,587,037 | 2/1952 | Glubiak | 70/414 |
| 3,673,895 | 7/1972 | DesJardins | 81/90 A |

FOREIGN PATENTS OR APPLICATIONS

| | | | |
|---|---|---|---|
| 1,131,456 | 2/1957 | France | 70/414 |

*Primary Examiner*—Gil Weidenfeld

*Attorney, Agent, or Firm*—Woodhams, Blanchard and Flynn

[57] ABSTRACT

Self-ejecting chuck key for a gear chuck. A coil spring is arranged on the key of a gear chuck around the shank thereof and between means for holding same in position. Said spring includes a number of turns enlarged to clear the bevel gear of the key and preferably extends beyond said gear to a point between the small end of said gear and the end of the key. Said spring is made sufficiently soft that it can bear on both the body and the jaw nut of the chuck simultaneously without interfering with the effective and convenient operation of the key.

19 Claims, 3 Drawing Figures

FIG. 1
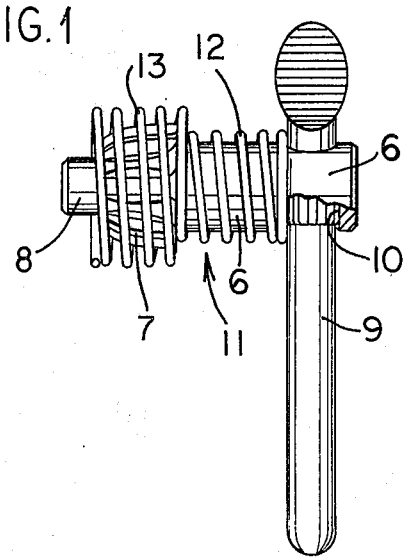
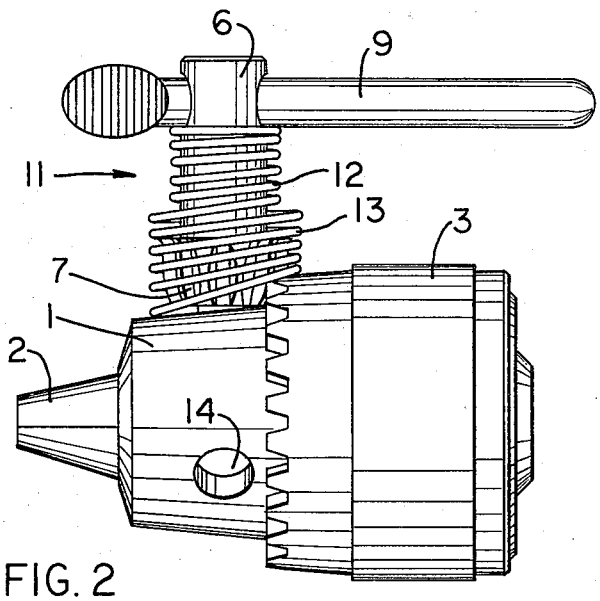
FIG. 2
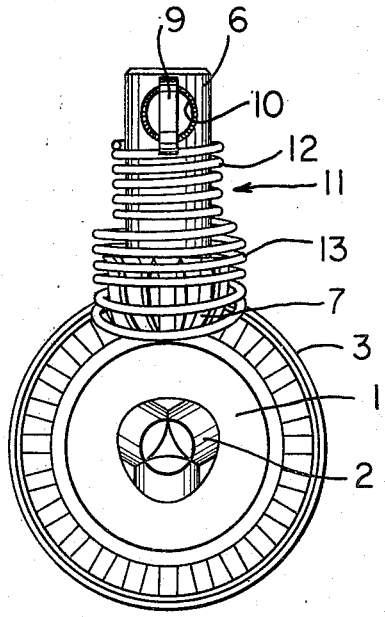
FIG. 3

SELF-EJECTING CHUCK KEY FOR GEAR CHUCK

FIELD OF THE INVENTION

The invention relates to a key for a gear chuck which in the interest of safety is made self-ejecting when an operator removes therefrom a manual pressure required to hold same in operating position, and particularly to such a key which utilizes no additional parts over a standard key other than a simple but unique spring configuration sleeved over an otherwise conventional key structure.

BACKGROUND OF THE INVENTION

It has been long known to provide a self-ejecting chuck key in order to insure that the key will be withdrawn from operating position on the chuck and thereby insure against its being inadvertently left in position upon starting of the machine. A number of designs have been offered for this purpose for upwards of fifty years and many are currently available on the market. However, for one reason or another, the previously known designs have not been fully satisfactory and it is the purpose of the present invention to provide such a chuck key which will be inexpensive and yet fully effective and reliable.

More particularly, certain keys of the prior art have utilized internal spring-loaded plungers which are coaxial with the gear on the key and bear against the chuck body. Such keys are held in position manually by the operator and when the manual force holding same in position is released, such spring-loaded plunger responds to the urging of a spring, pushes against the chuck body and ejects the key from its operating position. These keys are effective but they are expensive to manufacture and if the hole inside of the key which contains the plunger becomes loaded with dirt and/or metal particles the self-ejecting mechanism may become inoperative.

Another related form of such key provides for a plunger to lie in a longitudinal groove on a surface of the key and same is urged by a spring into an outwardly extended position. This plunger likewise bears against the chuck body and pushes the key out of operating position when the manual force thereon is removed. This is somewhat less expensive to make than the abovementioned type but it is still subject to being rendered inoperative if the plunger carrying slot becomes excessively loaded with dirt and/or particles of metal. Further, since the ejecting force of this key is eccentric to the gear and pilot for same, there is some tendency for the key to tilt in response to the urging of said spring-loaded plunger and, at least in some positions, certain such keys now on the market tend to bind in the pilot opening and/or on the bevel gear and fail to release.

Still other types of such keys utilize an external coaxial chuck body surrounding the key but functioning in the same manner as the above-mentioned plungers. This operates effectively in some instances but is not well adapted to use with a gear chuck inasmuch as the external chuck body will be prevented by the gear teeth from contacting other than the jaw nut of the chuck which again means that the force tending to retract the key from its operating position will be eccentric to the center of the key and cause same to tilt and occasionally bind in its operating position.

The foregoing three basic forms are expressed in a variety of particular ways in the prior art, but all of them insofar as I am aware involve one or more of the various problems mentioned above.

Accordingly, the objects and purposes of the invention include the following:

1. To provide a self-ejecting key for a gear chuck which will be inexpensive to manufacture but fully reliable under all normal conditions of operation.
2. To provide a self-ejecting key, as aforesaid, having no closely fitting or closely machined parts which can be rendered inoperative by accumulation of dirt and/or metal particles but will on the contrary be sufficiently free and open that such accumulation will not inhibit its operation.
3. To provide a self-ejecting chuck key, as aforesaid, wherein the ejecting force will be arranged at least substantially uniformly around and in alignment with the axis of the key whereby to minimize the likelihood of its being pushed angularly and thereby jamming in place.
4. To provide a self-ejecting chuck key, as aforesaid, wherein the mechanism for effecting the self-ejecting will be fully visible at all times and is such that if anything should occur which would inhibit its proper functioning, same can be readily seen and either corrected or the key replaced.
5. To provide a self-ejecting chuck key, as aforesaid, which will utilize for most of the final product a presently standard key, together with a single relatively inexpensive added part whereby same can be rapidly and inexpensively assembled from presently standard keys without special machining being done thereon and hence at a minimum of cost.

Other objects and purposes of the invention will be apparent to persons acquainted with apparatus of this type upon reading the following specification and inspection of the accompanying drawing.

BRIEF DESCRIPTION OF THE DRAWING

In the drawing:

FIG. 1 is a side view of a key embodying the invention.

FIG. 2 is a side view of a chuck with a key embodying the invention applied thereto.

FIG. 3 is a view from the left end of FIG. 1.

SUMMARY OF THE INVENTION

Briefly, the invention consists of providing a single spring coil of two diameters, the smaller diameter being captured in one preferred embodiment between the bevel gear and the handle of an otherwise standard chuck key and the larger diameter encircling the gear thereof. The said larger diameter is slightly larger than the maximum diameter of the bevel gear on the key and hence will not interfere with the positioning of said gear into position on the gear chuck. Said coil extends to a point near or slightly beyond the small end of the key gear to permit sufficient extension therebeyond of the key for piloting purposes but to still provide sufficient compression of the spring when the key is fully inserted to insure adequate compression thereof. Lastly, said spring is sufficiently soft that it will accommodate itself to the step provided by the chuck body and jaw nut without being unduly biased from an effectively operative position.

DETAILED DESCRIPTION

Referring first to FIG. 2, there is shown a chuck of a type with which the key of the invention is typically used, same being well known to those skilled in the art. Said chuck comprises a body 1 whose axial movement with respect to the jaws 2 cause same to expand or contract as desired for gripping a tool. The jaw nut 3 is coaxially mounted on, and for rotation with respect to, the body 1 and such rotation effects the desired relative axial movement between said body and said jaws. All of the foregoing is well known and needs no further or detailed description.

Referring now to the key (FIG. 1) by which said jaw nut is rotated with respect to said chuck body, it is equally well known to provide a key having a shank 6 carrying at one end thereof a bevel gear 7 (formed thereon as desired, such as by upsetting or by making separately and fastening thereto) and beyond which projects a pilot 8 of diameter somewhat smaller than that of the small end of said bevel gear 7. An opening 10 is provided through the other end of said shank 6 and a handle 9 extends therethrough, usually by a press fit such that when once installed it will stay firmly in place. As with the chuck above described, this type of key is well known, is made by a variety of different methods and needs no further detailing or describing.

Turning now to the subject of the present invention, there is provided a spring 11 coiled to two individually uniform diameters, same comprising portions 12 and 13 thereof. Said portion 12 is of preferably uniform diameter and is in this embodiment captured between the handle 9 and the large end of the bevel gear. While relatively little biasing will be required on this portion of the spring, it is preferred to have some compression thereof partly to insure its snug retention between the gear and the handle and partly for reasons which will appear more fully below. The part 13 of said spring is likewise of preferably uniform diameter and extends from a position substantially at the large end of the bevel gear to a point near the small end thereof, preferably somewhere between said small end and the end of the pilot 8.

In operation the key is placed into the usual pivot opening 14 in the chuck body so that the bevel gear thereon engages the gear teeth of the jaw nut for operation in the usual manner. When this is done, the large portion 13 of said spring will bear as shown in FIG. 2, namely, partly against said jaw nut and partly against said chuck body. Inasmuch as said large portion 13 of said spring is relatively short, it will quickly compress to a compression substantially equal to that of the small portion thereof at which time the effective compressive length of the spring is the full axial length thereof so that the difference in compression between the side contacting the jaw nut and the side contacting the chuck body will be relatively minor and in any position of the key with respect to the chuck a sufficiently uniform thrust will be placed onto the handle of the key to effectively push same out from engagement with the chuck when not manually held therein. Further, it will be noted that even to what extent an unevenness does exist in such thrust, it is greater on the side toward the engagement between the teeth of respective gears and hence to the extent, if any, that the key tends to tilt, it will tilt away from such gear engagement and hence will not bind therewith.

The spring is assembled into position from the handle end of the shank prior to insertion of the handle therein after which, with the spring appropriately depressed, the handle is inserted in the usual manner.

If desired, the large portion 13 of the spring may be flared slightly downwardly and outwardly in order to broaden its base of contact on the chuck. However, this adds to the expense of such spring and does not appear to provide commensurate improvement in operation and hence while possible it is not considered necessary.

Similarly, if desirable from the standpoint of ease in manufacture of the spring or in assembly technique, it is entirely possible that the upper coils of the small portion 12 of the spring may be made slightly smaller than the rest thereof. However, this likewise is of no great advantage and may even in some instances be disadvantageous. Preferably the entire spring should move smoothly and easily on the key so that even if it accumulates a substantial amount of dirt, metal chips and other foreign substances thereon, they will provide no real obstruction and compressive forces applied to the end of the spring adjacent the bevel gear will still be backed at least substantially at and by appropriately spaced means, here the handle. In this connection it will be further recognized that the visibility of the spring throughout its length will facilitate its remaining free and operable even though substantial amounts of oil, dirt and metal particles should accumulate thereon.

While it is preferred as above described to permit the spring portion 13 of the spring to contact both the chuck body 1 and the jaw nut 3, the key will operate reasonably effectively if said spring portion 13 contacts only the jaw nut 3. Hence such an arrangement is within at least the broader aspects of the present invention.

Further, while it is highly advantageous to capture the portion 12 of the spring between the handle and bevel gear as shown, it is also possible within the broader concept of the invention to provide other abutment means for capturing or retaining each or either end of such spring portion, such as flanges, pins or grooves.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a self-ejecting key for a gear chuck, said key having an elongated shank with a bevel gear at one end thereof and a handle spaced from said bevel gear and positioned adjacent the other end of said shank, and means providing axially spaced first and second abutment means on said shank and projecting radially with respect thereto, said first and second abutment means being disposed between said handle and said bevel gear, said first abutment means being disposed more closely adjacent said handle and said second abutment means being disposed more closely adjacent said bevel gear, the improvement comprising:

resilient means mounted on said shank and extending axially thereof from said first abutment means to a location disposed beyond the large end of said bevel gear for permitting self-ejecting of said key from a gear chuck;

said resilient means having a first resilient portion positioned radially outwardly of said shank and extending axially thereof, said first resilient portion being received between and engaged with said first and second abutment means; and said resilient means having a second resilient portion positioned radially outwardly of said bevel gear and extending axially of said shank from said second abutment means to said location.

2. The device of claim 1, wherein said second resilient portion encircles said bevel gear.

3. The device according to claim 2, wherein said second resilient portion comprises a coil spring member disposed externally of and surrounding said bevel gear.

4. The device according to claim 1, wherein said second resilient portion is resiliently compressible and has an end portion thereof adapted to abuttingly engage the gear chuck when the bevel gear is engaged therewith so that said second resilient portion is resiliently compressed and creates a force acting on said gear chuck which tends to self-eject said bevel gear from engagement with said gear chuck.

5. The device of claim 1, wherein said first resilient portion is maintained in a partially compressed condition when engaged with and between said first and second abutment means, and wherein said second resilient portion is resiliently compressible but is normally maintained in a noncompressed condition when the self-ejecting key is disengaged from the gear chuck.

6. The device of claim 1 wherein said resilient means is a coil spring.

7. In a self-ejecting key for a gear chuck, said key having an elongated shank with a bevel gear at one end thereof, a pilot extending axially of said gear and a handle spaced from said bevel gear and positioned on the other end thereof, means providing axially spaced first and second abutment means on said shank projecting radially with respect thereto, the improvement comprising:

resilient means having a first portion received between said first and said second abutment means and having a second portion positioned radially outwardly of said bevel gear and extending axially of said bevel gear beyond the large end thereof; and said resilient means comprising a coil spring having a first diameter and a second diameter defining said first and second portions, respectively, said first diameter being larger than that of said shank but less than that of said abutment means and said second diameter being larger than that of the large end of said bevel gear.

8. The device of claim 7 wherein the free end of the second portion of said spring terminates at a location disposed longitudinally between the small end of said bevel gear and the free end of said pilot.

9. The device of claim 7 wherein the first portion of said coil spring is of constant diameter.

10. The device of claim 7 wherein the second portion of said coil spring is of constant diameter.

11. The device of claim 1, wherein the first resilient portion is slightly resiliently compressed when positioned between and in engagement with said first and second abutment means, and wherein said first resilient portion is lifted out of engagement with said second abutment means before the free end of said second resilient portion reaches the position occupied by it when said key is in operating position with a gear chuck, whereby in such operating position the resilient means does not bear against said second abutment means but instead bears between said gear chuck and said first abutment means.

12. In a self-ejecting key for a gear chuck, said key having an elongated shank with a bevel gear at one end thereof and a handle spaced from said bevel gear and positioned on the other end thereof, means providing axially spaced first and second abutment means on said shank projecting radially with respect thereto, the improvement comprising:

resilient means having a first portion received between said first and second abutment means and having a second portion positioned radially outwardly of said bevel gear and extending axially of said bevel gear beyond the large end thereof;

said first portion of said resilient means comprising first coil spring means positioned in surrounding relationship to said shank and disposed between said first and second abutment means, and said second portion of said resilient means comprising second coil spring means positioned in surrounding relationship to said bevel gear, said first and second coil spring means being coaxially aligned with one another and having their adjacent ends fixedly interconnected; and said resilient means including engagement means associated with said first and second coil spring means in the vicinity of the adjacent ends thereof for abuttingly engaging said second abutment means.

13. The device of claim 12 wherein said first abutment means is said handle.

14. The device of claim 12 wherein said second abutment means comprises a surface formed at the large end of said bevel gear.

15. The device of claim 12, wherein the adjacent ends of said first and second coil spring means are of substantially different diameters and with the end of said first coil spring means being substantially smaller than the adjacent end of said second coil spring means, whereby said end of said first coil spring means comprises said engagement means and abuttingly engages said second abutment means.

16. The device of claim 12, wherein said second coil spring means surrounds said bevel gear and extends axially throughout at least the complete length of the bevel gear.

17. In a self-ejecting key for a gear chuck, said key having an elongated shank with a bevel gear at one end thereof and a handle spaced from said bevel gear and positioned on the other end thereof, means providing axially spaced first and second abutment means on said shank projecting radially with respect thereto, the improvement comprising:

resilient means having one portion received between said first and second abutment means and having a second portion positioned radially outwardly of said bevel gear and extending axially of said bevel gear beyond the large end thereof;

said resilient means including a coil spring having first and second coiled parts defining said first and second portions, respectively, the first coiled part being positioned in surrounding relationship to said shank and having one end thereof disposed in abutting engagement with said first abutment means, the other end of said first coiled part being fixedly interconnected to an adjacent end of said second coiled part, said second coiled part being disposed in surrounding relationship to said bevel gear; and said resilient means further including stop means located intermediate the ends of said coil spring and positioned for engagement with said second abutment means.

18. The device of claim 17, wherein said stop means comprises one of the coils of said coil spring, said one coil being located intermediate the ends of said coil spring.

19. The device of claim 1, wherein said first abutment means is formed by said handle.

* * * * *